United States Patent [19]

Kozlowski et al.

[11] 3,987,139

[45] Oct. 19, 1976

[54] PROCESS OF FORMING SYNTHETIC FIBERS

[75] Inventors: John H. Kozlowski, Vancouver, Wash.; Robert E. Howard, Portland, Oreg.

[73] Assignee: Crown Zellerbach Corporation, San Francisco, Calif.

[22] Filed: July 29, 1974

[21] Appl. No.: 492,563

Related U.S. Application Data

[63] Continuation of Ser. No. 236,233, March 20, 1972, abandoned.

[52] U.S. Cl. ..... 264/141; 162/157 R; 162/164 R; 260/29.6 WQ; 260/75 T; 260/75 S; 264/13; 526/308; 526/346; 526/348

[51] Int. Cl.[2] ..... B29C 6/00; B22D 23/08

[58] Field of Search ..... 264/205, 141, 13, 5; 260/94.9 G, 94.9 F, 94.9 GD, 94.9 A, 29.6 XA, 78 S, 75 NA, 75 T, 29.6 PM, 29.6 WQ; 162/157 R, 164 R

[56] References Cited

UNITED STATES PATENTS

| | | | |
|---|---|---|---|
| 2,728,753 | 12/1955 | Russum et al. | 260/94.9 F |
| 3,674,736 | 7/1972 | Lerman et al. | 264/5 |
| 3,703,502 | 11/1972 | Venderbos et al. | 260/94.9 F |
| 3,730,918 | 5/1973 | Teti et al. | 260/30.6 R |
| 3,770,856 | 11/1973 | Ueki et al. | 260/34.2 |
| 3,774,387 | 11/1973 | Woodell | 161/172 |
| 3,808,091 | 4/1974 | Aoki et al. | 162/157 R |
| 3,848,027 | 11/1974 | Forbess et al. | 260/94.9 F |
| 3,885,014 | 5/1975 | Fukada et al. | 264/176 F |

*Primary Examiner*—Jay H. Woo
*Attorney, Agent, or Firm*—Jerome S. Marger; Corwin R. Horton

[57] ABSTRACT

A process of preparing polymer fibers by adiabatically flashing an emulsion or dispersion of water or other suitable nonsolvent in molten polymer, the emulsion or dispersion including an emulsifying agent and a dispersing aid, at an elevated temperature and pressure through a narrow orifice into a region of reduced temperature and pressure. The water or other nonsolvent is present in an amount effective, in combination with the temperature and pressure employed, to cause the molten polymer to be disrupted and rapidly solidify in the form of high surface area, i.e., at least 1.0 $m^2$/gram, discrete fibers. The polymer is preferably a crystalline polymer. The nonsolvent employed should have a boiling point less than the melting point of the polymer, a critical temperature greater than the melting point of the polymer, a heat of vaporization greater than the heat of fusion of the polymer, and is substantially immiscible in the polymer at the temperature of flashing.

18 Claims, No Drawings

PROCESS OF FORMING SYNTHETIC FIBERS

CROSS-REFERENCE TO RELATED APPLICATION

This is a continuation of U.S. application, Ser. No. 236,233, filed Mar. 20, 1972 and now abandoned.

BACKGROUND OF THE INVENTION

The formation of fibers or filaments of various polymers has previously been effected by extruding a molten polymer through spinnerets with the formation of continuous filaments and subsequently chopping such filaments into staple fibers.

Another approach has been to form so-called "fibrids" by introducing a solution of a polymer into a nonsolvent for the polymer under agitation. The formation of such fibrids is described in U.S. Pat. Nos. 2,999,788; 2,988,782; and 2,708,617.

Continuous filaments having a three-dimensional integral plexus structure and called plexifilaments are described in U.S. Pat. Nos. 3,081,519; 3,227,664; and 3,227,784. This process involves flashing a solution of polymer through an orifice under conditions such that substantially all of the solvent flashes off leaving a continuous filamentary structure.

A process of forming microfibers by melting a synthetic polymer and applying a gaseous jet to a thin layer of the molten polymer is described in U.S. Pat. No. 3,016,599.

The production of a continuous, foamed filament by extrusion of a mixture of a blowing agent and a polymer is described in U.S. Pat. Nos. 3,480,507 and 3,542,909.

A process for preparing polyacrylonitrile fibers by extruding a two-phase melt of the polymer in water into a stream of steam is described in U.S. Pat. No. 3,402,231. The fibers are in the form of a loosely constructed, continuous strand. The polymer concentration is less than 30% of the slurry.

SUMMARY OF THE PRESENT INVENTION

The present process produces discrete polymer fibers by adiabatically flashing an emulsion or dispersion of water or other nonsolvent in molten polymer, the emulsion or dispersion including an emulsifying agent and a dispersing aid, at an elevated temperature below the critical temperature of the nonsolvent and under autogenous or higher pressure through a narrow orifice into a region of reduced temperature and pressure, preferably atmospheric pressure and room temperature. The water or other nonsolvent rapidly vaporizes or flashes to disrupt the polymer into discrete high-surface-area fibers and to cool the polymer to a temperature below the melting point so that the fibers do not fuse to one another. Alternatively, the process can be operated under conditions such that a very long strand or filament of loosely connected fibers is formed.

DESCRIPTION OF PREFERRED EMBODIMENTS

The present process forms a water-in-oil type emulsion or dispersion rather than an oil-in-water type. That is, in the present process the polymer forms the continuous phase of the emulsion or dispersion and the water or other nonsolvent forms the discontinuous phase.

This has been found to be important since if the water or other nonsolvent forms the continuous phase and the polymer forms the discontinuous phase, upon adiabatic expansion of a heated mass thereof the water or other nonsolvent rapidly expands away from polymer droplets and has little opportunity to disrupt the polymer into fibers. When the water or nonsolvent forms a discontinuous phase and the polymer the continuous phase, upon adiabatic expansion of the water or other nonsolvent, a violent disruption of the polymer from the inside out occurs causing fiber formation.

In preparing the emulsion or dispersion of the present invention, it is preferred to employ the polymer in the form of fine particles. While polymer particles as large as conventional pellet-size could be employed, especially where the emulsifiers and nonsolvent are added to the melt, it is much preferred to preblend the ingredients and employ a much smaller size particle, preferably one that is smaller than 50-mesh, and most desirably less than 150-mesh.

The dry polymer particles are first blended with a suitable emulsifying agent, a dispersing aid, and the appropriate amount of water or other nonsolvents. It is important that this blending be carried out to provide a uniform dispersion of the water or other nonsolvents in the polymer. While the emulsifying agents and dispersing aids in water can be added to the molten polymer, this is the least preferred way of blending the materials in view of the high power required in stirring a molten polymer due to its high viscosity.

After the blend of polymer, emulsifying agents, dispersing aids and water, or other nonsolvent, is made, it is heated to a temperature above the melting point of the polymer under autogenous or higher pressure. The temperature to which the blend is heated should be less than the critical temperature of the water or other nonsolvent in order to maintain the water or nonsolvent in the liquid phase. The water or other nonsolvent should be kept in the liquid phase in order that, upon adiabatic expansion, the heat of vaporization is available to quickly cool the molten polymer to a temperature below its melting point.

The molten polymer emulsion or dispersion can be stirred to aid in forming or maintaining a uniform dispersion of the water throughout the molten polymer mass, although this is not essential if preblending has been carefully carried out.

The molten emulsion or dispersion is then adiabatically flashed through an orifice into a region of lower temperature and pressure, preferably into a region at room temperature and atmospheric pressure. The water or other nonsolvent immediately flashes from the emulsion or dispersion thereby disrupting the polymer into the form of fibers and also cools the polymer to a temperature below its melting point. The amount of water or other nonsolvent should be sufficient, at the temperature and pressure employed, to both disrupt the polymer into fibers and to provide sufficient cooling of the polymer so that it is rendered non-molten or non-tacky.

The velocity of the emulsion or dispersion through the orifice is desirably fairly rapid in order to impart some orientation to the polymer molecules.

Upon adiabatic vaporization of the water or other nonsolvent, the molten polymer is violently disrupted into the form of high-surface-area fibers and substantially immediately cooled to a temperature where they are nontacky and do not fuse together. Fibers collected at a distance of several meters from the orifice are cool to the touch of the hand. The fibers may be collected by any conventional technique such as upon a foraminous moving surface, or in a hopper. The fibers may also be deposited into a body of water if they are to be formed into a nonwoven web by conventional papermaking techniques.

The polymers that may be employed in the process of the present invention are any of those which are fiber-forming and can form a melt without carbonization or degradation. Preferably, the polymer employed would have a melting point higher than the boiling point of water since this is the preferred nonsolvent. However, when other nonsolvents are employed having a boiling point less that that of water, the polymer chosen can have a melting point lower than the boiling point of water as long as its melting point is higher than the boiling point of the particular nonsolvent chosen. The molecular weight of the polymer should be such that the viscosity in the melt is less than 2,500 centipoises and preferably less than 500 centipoises.

It is preferred to employ crystalline polymers because of their potentially higher strength properties due to molecular orientation. Particularly preferred among the crystalline polymers are the crystalline polyolefins such as linear polyethylene, isotactic polypropylene, copolymers of ethylene and propylene, and polymers of 1-butene, 1-pentene, 4-methyl, pentene-1 and cyclic and aryl substituted olefins such as vinylcyclohexane and styrene. Crystalline copolymers and block copolymers of the foregoing olefins are also satisfactory.

Other crystalline polymers that may be employed include polyamides such as nylon-66, polyurethanes (both aliphatic and aromatic), and polyesters such as polyethylene and terephthalate.

Common polymer additives such as dyes, pigments, anti-oxidants, delusterants, anti-static agents, reinforcing particles, adhesion promoters, removable particles, ion exchange materials, UV stabilizers and the like may be mixed with the polymer prior to preparation of the emulsions or dispersions of the present invention.

If the process of the present invention is to be integrated with an existing polymerization process, minor amounts of residual solvent may be left in the polymer without detrimentally affecting the process. In fact, where higher molecular weight polymers are to be employed, or polymers having a high degree of chain branching, it may be desirable to incorporate a small amount of solvent into the blend to lower the viscosity.

Emulsifying agents are used in combination with the hereinafter described dispersing aids for preparing the emulsion or dispersion of the present invention. Conventional emulsifying agents or combinations of emulsifying agents employed in preparing water-in-oil type emulsions or dispersions may be employed. Such emulsifying agents are characterized by their low HLB value (hydrophilic-lipophilic balance), i.e., emulsifiers suitable for the present invention should have an HLB value less than 7.0. The emulsifier should preferentially dissolve in the polymer rather than in the water or other nonsolvent-phase.

Particularly preferred emulsifying agents are the stearates such as calcium or aluminum stearates. Other suitable emulsifying agents which may be employed either alone or in combination with each other or with the stearates, include cellulose ethers, higher esters of sorbitan, sold under the trademark "SPAN" by ICI America Inc., anionic surfactants which are substantially insoluble in water such as amine salts of alkyl aryl sulfonates and amine salts of alkyl sulfates, and bis (alkyl) sulfosuccinate monovalent salts, aryl nonionic surfactants such as alkyl aryl polyethylene glycol, alkyl polyethylene glycol and products of esterification of saturated and unsaturated fatty acids of long and short chains.

The amount of emulsifying agent employed depends upon the particular polymer employed and the amount of water or other nonsolvent to be dispersed. Generally, emulsifying agents may be employed in amounts ranging from about 0.5%–20% by weight of the polymer, preferably from about 2% to about 10%.

Under the conditions described herein, it has been found that in order to form the requisite high-surface-area fibers, it is necessary to add a solid hydrophilic dispersing aid to the emulsion or dispersion prior to adiabatic flashing. Such a dispersing aid is preferably capable of being prepared in a finely divided form, less than about 50-mesh in size and preferably less than about 150-mesh in size. The dispersing aid must not melt or degrade at the temperatures employed, and should not react with the polymer, emulsifying agent or nonsolvent. It is hypothesized that the dispersing aid acts in the nature of tiny sponges that hold the water or other nonsolvent in a dispersed condition and thereby prevents agglomeration of the nonsolvent droplets or phase separation. Examples of suitable dispersing aids include clays such as bentonite, fuller's earth, diatomaceous earth, Santocel (silica aerogel), Cab-O-Sil, and others. Bentonite clay is especially preferred because of its low cost.

The amount of dispersing aid employed depends upon the amount of water or other nonsolvent employed in preparing the emulsion or dispersion, and generally ranges from about 1% to 25% be weight of the polymer, preferably from about 4.0% to about 10% by weight.

It is preferred to dry-blend the polymer particles, emulsifying agents and dispersing aids prior to addition of water or other nonsolvent.

Water is the preferred nonsolvent employed in preparing the emulsions or dispersions of the present invention. However, other liquids which are nonsolvents or are immiscible with the polymer at the temperatures and pressures employed can be used. The nonsolvent should be a liquid at the temperature and pressure employed in preparing the emulsion or dispersion, should have a boiling point that is less than the melting point of the polymer employed, should have a critical temperature which is greater than the melting point of the polymer, and should have a heat of vaporization which is greater than the heat of fusion of the polymer employed, and preferably at least twice as great.

The reason for this is that the polymer must be cooled very rapidly down to a temperature below its melting point and to a temperature where it is substantially nontacky in order that the fibers that are formed do not fuse together into clumps which are difficult or impossible to separate. Therefore, the heat of vaporization of the nonsolvent must be sufficient to absorb the heat of fusion of the polymer as it passes through the melting range. In addition, the vaporizing nonsolvent must also be able to absorb the heat required to lower the temperature of the molten polymer from the emulsion temperature to the melting range.

While for temperatures only slightly above the melting range of the polymer, this latter heat quantity may be substantially ignored; as the temperatures increase above the melting range, this quantity becomes a significant factor. For example, polyethylene has a heat of fusion of about 69 calories/gram. If the melting point of polyethylene is taken as 132° C., at 137° C. the amount of heat given up in cooling to the melting point is only three calories per gram, whereas at 187° C., the amount of heat given up in cooling to the melting point is about 34 calories/gram. Similarly, polypropylene has a heat of fusion of 45 calories per gram; and if the melting point is assumed to be 156° C., the number of calories given up in cooling from 211° C. is 30 calories per gram; whereas at 189° C., it is only 15 calories per gram.

The statement that the heat of vaporization of the nonsolvent should be greater than the heat of fusion of the polymer and preferably at least twice as great (to take into account the calories absorbed in cooling the polymer to the melting point) should be construed as including the amount of nonsolvent as a factor rather than the absolute heat of vaporization in calories per gram of nonsolvent. That is, the amount of nonsolvent must be taken into account as well as the nature of the nonsolvent in determining whether or not the heat of vaporization will be sufficient to rapidly cool the temperature to below its melting point.

Examples of suitable nonaqueous nonsolvents that may be employed in the present process include ethyl alcohol, methyl alcohol, propyl alcohol, nitromethane and acetonitrile.

The amount of water or other nonsolvent employed in preparing the emulsions or dispersions of the present invention should be greater than the minimum amount necessary, taking into consideration the heat of vaporization of the nonsolvent chosen, to rapidly cool the polymer to a temperature below its melting point upon adiabatic vaporization of the nonsolvent. In addition there must be enough nonsolvent present to violently disrupt the polymer into the form of fibers. Generally speaking, if the amount of nonsolvent present is sufficient to rapidly cool the polymer to a temperature below its melting point, there will usually be sufficient vapor generated to effect the desired disruption. It is desirable in most cases, depending upon the nature of the fibers desired, to employ an amount greater than this minimum amount in order to assure sufficient disruption and also to control the size and nature of the fibers formed. Generally, the more disruption generated, the smaller and better formed are the fibers.

The maximum amount of water or other nonsolvent employed is that amount which would cause inversion of the emulsion or suspension into an oil-in-water type, i.e., that level at which the water or other nonsolvent would become the continuous phase and the polymer would become the noncontinuous phase.

It has been found to be generally desirable to employ the nonsolvent in an amount between about 15% and 45% by weight of the polymer.

However, it is possible to use more nonsolvent in the system be preparing a dual emulsion. Such a dual emulsion would entail preparing an emulsion or dispersion of the water or other nonsolvent in the polymer as previously described, and then suspending or emulsifying such emulsion or dispersion in a large amount of water or other nonsolvent as an outer continuous phase carrying the previously prepared emulsion or dispersion as the discontinuous phase. The employment of such a dual emulsion has the advantage of permitting easy control of the viscosity of the mass, i.e., there may be a limit on the molecular weight and/or degree of chain branching of the polymer employed in a single emulsion or dispersion procedure due to the high viscosity of the molten polymer which could be overcome by the employment of a dual emulsion. Therefore, wherever it is stated herein that an emulsion or dispersion of water or other nonsolvent in polymer is adiabatically flashed through an orifice, it is intended to include both the case where the emulsion or dispersion is itself adiabatically flashed or the case where a dual emulsion is prepared which carries the nonsolvent-in-polymer emulsion or dispersion, as just described.

Additives to impart water dispersibility to the polymer fibers to be formed may be blended into the mix prior to or after forming the emulsion. Particularly preferred is polyvinyl alcohol which is water-soluble and may be added with the water when it is used as the nonsolvent.

The emulsion of dispersion of water or nonsolvent in the polymer, and containing the necessary emulsifying agents and dispersing aids, is heated to a temperature above the melting point of a polymer and below the critical temperature of the water or nonsolvent employed. Preferably, the temperature employed is much higher than the melting point of the polymer and approaches that temperature at which substantial degradation of the polymer begins to occur. The higher the temperature employed the greater the driving force of the water or the nonsolvent in effecting disruption of the polymer to fibers. Therefore, as a general rule, it can be said that the temperature employed would be in the range of temperatures normally employed in conventionally extruding the polymer by itself. For polyethylene as the polymer and water as the nonsolvent, a temperature range of 180° –250° C. is preferred.

The pressure employed in the system is at least autogenous and preferably higher. The pressure is at least autogenous in order to keep the water or other nonsolvent in a liquid phase. If the water or other nonsolvent is permitted to enter the gas phase prior to adiabatic expansion, the heat of vaporization is not available to cool the polymer.

It is preferred to employ a pressure higher than autogenous pressure and this additional pressure can be imparted to the system by the use of an inert gas in the free vapor space of the system. Such additional pressure is desirable in order to increase the velocity at which the emulsion or dispersion is adiabatically flashed through the extrusion orifice. The only upper limit on the excess pressure imparted to the system is the mechanical limitations of the apparatus employed. The additional pressure imparted to the system can range up to 1,000 psia, or greater, over the autogenous pressure and preferably is at least 100 psia greater than autogenous pressure.

The emulsion or dispersion at the operating temperature may be stirred, although this is not essential if the emulsion or dispersion has been uniformly preblended prior to raising the temperature.

As previously mentioned, the polymer particles by themselves, or with the emulsifying agents and dispersing aids blended therewith, may be heated to a temperature above the melting point and the nonsolvent, with or without dispersing agents and dispersing aids, can then be added to the molten polymer mass with agitation to form the emulsion or dispersion. However, in view of the high viscosity normally encountered in most polymer melts, this is not the preferred procedure for preparing the emulsion or suspension in view of the large amount of energy required for such mixing.

Once the emulsion or dispersion has attained the proper temperature and pressure, it is rapidly passed through an extrusion orifice or nozzle and the water or other nonsolvent adiabatically flashed therefrom to form discrete polymer fibers. It is very desirable that the emulsion or suspension be kept at the operating temperature and pressure until it passes through the orifice or nozzle, and therefore heating of the orifice or nozzle may be necessary due to the cooling effect of the flashing. Also, the additional pressure imparted to the system by use of nitrogen or other inert gas should be sufficient to compensate for any pressure drop that may occur along the conduit leading to the extrusion orifice or nozzle in order to assure the water or other nonsolvent is maintained in the liquid phase.

The size of the extrusion orifice or nozzle is not critical. However, the nozzle should be large enough to prevent plugging by any solid dispersing aid that may be employed and should be small enough for the amount of material passing therethrough per unit of time to impart some orientation to the polymer.

The particular apparatus employed in carrying out the process of the present invention is not critical. For a batch process, an autoclave can be employed for heating the emulsion or dispersion to the proper temperature and pressure, and the emulsion or dispersion flashed through an orifice or nozzle located on the autoclave or at a distance from the autoclave and connected thereto by a suitable conduit. For a continuous process, the heating and pressurizing of the emulsion or dispersion can be effected in a conventional polymer extrusion apparatus with the outlet being connected to an orifice or nozzle of suitable size. The components can be preblended or can be blended in the extrusion device itself.

EXAMPLE 1

1,500 grams of high density polyethylene having an intrinsic viscosity of 1.4 and a viscosity average molecular weight of 90,000 in the form of a powder (100% of which passes a 50-mesh screen) was uniformly blended with 100 grams of calcium stearate, 22 grams of SPAN 65 (sorbitan tristearate having an HLB of about 2.1), and 100 grams of bentonite clay. After the polyethylene, calcium stearate, SPAN 65 and bentonite were thoroughly mixed, 600 milliliters of water were uniformly mixed therein. The mixture was placed into a 1-gallon Benco autoclave Model No. 30-200 which was externally heated. The autoclave had an inside diameter of 6½ inches and an inside height of 10½ inches and was constructed of stainless steel. The autoclave was equipped with a 4-blade propeller stirrer. Prior to heating the contents of the autoclave, the lid was clamped thereon and the autoclave and its contents purged with nitrogen four times. The contents were then heated to a temperature of 205° C. and pressurized to 500 psig with nitrogen. It took a period of 4 hours to get the contents of the autoclave to the temperature and pressure. During heating the stirrer was operated at 40 rpm. The autoclave had a ½-inch pipe exiting from the bottom thereof in a vertical direction for 4 inches which was connected to a right-angle elbow which in turn was connected to a horizontal section of ½-inch pipe which had a length of 4½ inches. A quick opening ¾-inch ball valve was located in the horizontal section of pipe 2½ inches from the elbow. A 1/16-inch orifice was located at the outlet end of the horizontal pipe section. The valve was opened and the emulsion quickly passed through the outlet orifice into the atmosphere forming a large mass of white, discrete polyethylene fibers. These fibers had a surface area of 2.6 meters$^2$/gram and a crystallinity of 61%. The fibers were passed six times through a Sprout Waldron disc refiner at a consistency of about 1.0% in water to which had been added 1% by weight of the fibers of polyvinyl alcohol to render the fibers water-dispersible. The fibers were collected and fiber fractionation determined in accordance with TAPPI Test T 233 su 64. The results are as follows:

Fiber Fractionation

| Mesh | Weight % |
|---|---|
| On + 20-mesh | 38.0 |
| On + 35-mesh | 34.8 |
| On + 65-mesh | 11.8 |
| On + 150-mesh | 4.0 |
| On + 270-mesh | 1.1 |
| Through 270-mesh | 10.3 |

EXAMPLE 2

The high density polyethylene of Example 1 was blended in an amount of 2,000 grams with 75 grams of calcium stearate and 75 grams of bentonite clay. After thorough mixing, 800 milliliters of water were uniformly blended therein. The mixture was placed in a 2-gallon stainless steel autoclave manufactured by Autoclave Engineering (Ser. No. 5511) which had an inside diameter of 6½ inches and an inside height of 14 inches. The autoclave was externally heated. The autoclave was equipped with a ¾-inch pipe extending through the lid to within 2 inches of the bottom of the autoclave. The pipe extended about 1 inch down the lid, and was connected with an elbow to a horizontal ¾-inch pipe section 5 inches long. A 3/16 -inch ball valve was located at the outlet end of the horizontal pipe section and acted as the outlet orifice. The autoclave was equipped with a 6-blade propeller stirrer. The polyethylene mix was placed into the autoclave, the lid clamped thereon, and the contents purged four times with nitrogen. The contents were heated to a temperature of 280° C. and pressurized to 750 psig. It took 2 hours to get the contents to this temperature and pressure, and during heating the stirrer was operated at 10–30 rpm. The ball valve was then opened and the emulsion quickly passed therethrough into the atmosphere forming a mass of white, discrete polyethylene fibers. These fibers had a surface area of 2.3 meters$^2$/gram, and a crystallinity of 64%.

EXAMPLE 3

The apparatus of Example 1 was employed. 1,500 grams of the polyethylene employed in Example 1, 50 grams of aluminum stearate, 25 grams of SPAN-60 (sorbitan monostearate having an HLB of about 4.7), and 75 grams of bentonite clay were uniformly blended together and 600 milliliters of water uniformly blended therein. The contents were placed into the autoclave and heated to 185° C. and 500 psig. The stirrer was operated at 5 rpm. The emulsion was then flashed through a 1/16-inch orifice into the atmosphere. A mass of discrete polyethylene fibers were obtained having a surface area of 3.1 meters$^2$/gram, a birefringence of 0.024 and a crystallinity of 72.4%.

EXAMPLE 4

Example 3 was repeated employing 25 grams of aluminum stearate, 50 grams of SPAN-60, 100 grams of bentonite clay and 1,500 grams of polyethylene of Example 1. 600 milliliters of water were blended therein and the contents added to the autoclave which was purged with nitrogen four times and then heated to 205° C. and 500 psig. The stirrer was operated at 15 rpm. The contents of the autoclave were then flashed through a 1/32-inch orifice into the atmosphere and a mass of polyethylene fibers were obtained having a surface area of 2.6 meters$^2$/gram.

EXAMPLE 5

The autoclave of Example 2 was employed using 2,000 grams of high density polyethylene having an intrinisic viscosity of 2.1 (viscosity average molecular weight of 150,000) into which was blended 200 grams of bentonite. No emulsifiers were employed. 1,100 milliliters of water were then added thereto and the mixture placed into the autoclave. The contents of the autoclave were purged with nitrogen four times and raised to a temperature of 270° C. and pressure of 700 psig. The stirrer was not operated. The contents were then flashed through the 3/16-inch ball valve into the atmosphere and a mass of discrete polyethylene fibers were obtained.

EXAMPLE 6

The autoclave of Example 1 was employed. The polyethylene of Example 1, in the amount of 1,500 grams, was uniformly blended with 50 grams of aluminum stearate and 50 grams of SPAN-65. No bentonite was employed. Water was blended therein to the extent of 700 milliliters, and the blend placed into the autoclave. The sealed autoclave was purged four times with nitrogen and the temperature raised to 240° C. and the pressure to 380–580 psig; the stirrer was operated at 20 rpm. The contents were then adiabatically flashed into the atmosphere through a 1/16-inch orifice forming a mass of white, discrete polyethylene fibers.

EXAMPLE 7

This example illustrates the preparation of fibers by use of a conventional extruder. A 1¼ inch diameter extruder built by Thermoplastic Equipment Corporation (Ser. No. 0966) having a 25-inch barrel length was charged with 10 pounds of the polyethylene of Example 1 which had first been uniformly blended with ½-pound of calcium stearate and ½-pound of bentonite followed by uniformly blending therein 1,200 milliliters of water. The blending was carried out in a V-mixer. The extruder screw was operated at 100 rpm with its 3-horsepower motor. A 1/32-inch diameter nozzle was attached to the end of the barrel. The temperature in the barrel and at the nozzle was 500° F., and the pressure at the nozzle was 500 psig. No screen pack was employed. The extruder was positioned at a 30° angle to the horizontal with the outlet and pointing downwardly. The throat of the extruder was water-cooled to prevent agglomeration of the powdery charge. White, discrete polyethylene fibers were obtained as the extruded product.

The fibers produced by the present process are characterized by their high surface area (greater than about 1.0 m$^2$/gram). The size of the fibers can range from as short as about 0.1 mm to almost continuous, preferably less than about 10 mm. The length of the fibers can be controlled by the temperature and/or pressure of the emulsion, the amount of nonsolvent employed and the size of the orifice. In general, the higher the temperature and/or pressure and the larger the amount of nonsolvent, the shorter the fibers. The lower the temperature and/or pressure and the smaller the amount of nonsolvent, the more likely the product will be a long strand or filament of loosely connected fibers.

While in the foregoing descriptions and specific examples reference is made to employing a single polymer, it is possible to employ mixtures of polymers and/or copolymers in preparing the emulsion.

What is claimed is:

1. A process for producing discrete polymer fibers having a surface area greater than 1.0 m$^2$/g, comprising the steps of:

a. forming a water-in-oil emulsion consisting essentially of a continuous phase formed of a molten crystalline fiber-forming polymer, a discontinuous phase formed of from about 15 to 45% by weight, based on the weight of said molten polymer, of water, from about 0.5 to 20% by weight, based on the weight of said polymer, of at least one emulsifying agent having an HLB value less than 7.0, and from about 1.0 to 25% by weight, based on the weight of said polymer, of a solid hydrophilic dispersing aid, the molten polymer forming said continuous phase
   i. being substantially immiscible in water,
   ii. having a molecular weight such that its melt viscosity in the molten form is less than 2500 centipoises,
   iii. having a melting point higher than the boiling point of water, and
   iv. having a critical temperature lower than that of water;

b. pressurizing the emulsion to at least an autogeneous level, during the formation of said emulsion, while at the same time maintaining the emulsion at a temperature above the melting point of the polymer, but below the critical temperature of the water; and c. discharging the emulsion through an orifice into a region of lower pressure to adiabatically vaporize substantially all of the water and violently disrupt the polymer thereby producing the subject high-surface-area fibers, the amount of water present being greater than the minimum amount necessary to cool the polymer to a temperature below the polymer melting point upon adiabatic evaporation of the emulsion.

2. The process of claim 1, wherein the crystalline polymer does not degrade upon melting.

3. The process of claim 1, wherein the crystalline polymer is a polyolefin.

4. The process of claim 1, wherein the crystalline polymer is selected from the group consisting of polyolefins such as linear polyethylene, isotactic polypropylene, copolymers of ethylene and propylene, polymers of 1-butene, 1-pentene, 4-methyl, butene-1, cyclic and aryl-substituted olefins such as vinyl-cyclohexane and styrene, and crystalline copolymers and block polymers of said olefins, polyamides such as nylon-66, aliphatic and aromatic polyurethanes, and polyesters such as polyethylene terephthalate.

5. The process of claim 4, wherein the crystalline polyolefin is formed from an olefin selected from the group consisting of ethylene propylene, and mixtures thereof.

6. The process of claim 1, wherein the emulsifying agent is a stearate.

7. The process of claim 1, wherein the dispersing aid is a clay.

8. The process of claim 1, wherein the pressure employed is at least 100 psia greater than autogenous pressure.

9. The process of claim 1, wherein the molten emulsion is adiabatically flashed through the orifice into a region maintained at room temperature and atmospheric pressure.

10. The process of claim 1, wherein the polymer is linear polyethylene.

11. A process for producing discrete polymer fibers having a surface area greater than 1.0 $m^2/g$, comprising:

a. forming a water-in-oil emulsion consisting essentially of
   i. a continuous phase formed of a solid fiber-forming crystalline polymer that can form a melt without carbonization or degradation, having a molecular weight such that the viscosity in the melt is less than 2500 centipoises, having a melting point higher than the boiling point and lower than the critical temperature of water, having a heat of fusion less than the heat of vaporization of water, and being substantially immiscible in water,
   ii. a discontinuous phase formed of from about 15% to about 45% by weight of water, based on the weight of said polymer.
   iii. from about 0.5 to 20% by weight, based on the weight of said fiber-forming polymer, of at least one emulsifying agent having an HLB value less than 7.0, and
   iv. from about 1to 25% by weight, based on the weight of said fiber-forming polymer, of a solid hydrophilic dispersing aid;
b. heating the emulsion to a temperature above the melting point of said continuous polymer phase and below the critical temperature of the discontinuous water phase;
c. pressurizing the emulsion to at least an autogenous level;
d. adiabatically vaporizing substantially all of the water by discharging the water-in-oil emulsion through an orifice into a region of lower pressure than previously imparted to the emulsion, causing the polymer phase to disrupt and form discrete high-surface-area fibers.

12. The process of claim 11, wherein the crystalline polymer, prior to forming said emulsion, is finely divided so that substantially all of the divided polymer will pass a 50-mesh screen.

13. The process of claim 12, wherein the dispersing aid is in finely divided form less than about 50-mesh in size.

14. The process of claim 11, wherein the emulsion components are uniformly blended prior to heating above the melting point of the polymer.

15. A process of preparing discrete polyethylene fibers comprising the steps of:

a. uniformly blending to form a water-in-oil emulsion consisting essentially of
   i. finely divided solid linear polyethylene having a melt viscosity of less than 2500 centipoises,
   ii. about 0.5 to 20% by weight, based on the weight of polyethylene, of at least one emulsifying agent having an HLB value less than 7.0,
   iii. about 1.0 to 20% by weight, based on the weight of said polyethylene, of a solid hydrophilic dispersing aid, and,
   iv. about 15 to 45% by weight of water, based on the weight of polyethylene;
b. heating the resultant emulsion to a temperature of between about 180° and 250° C.;
c. pressurizing the resulting emulsion to a pressure at least 100 psia higher than autogenous pressure with an inert gas; and
d. discharging the emulsion through an orifice into a region of reduced pressure to adiabatically vaporize substantially all of the water from the emulsion and disrupting the heated polyethylene and forming discrete polyethylene fibers having a surface area of at least 1.0 $m^2/g$.

16. The process of claim 15, wherein a solid hydrophillic dispersing aid having a particle size less than about 50-mesh is employed.

17. The process of claim 15, wherein the dispersing aid is a clay.

18. The process of claim 15, wherein the dispersing aid is bentonite clay.

* * * * *